US005344027A

United States Patent [19]

Kaplan

[11] Patent Number: 5,344,027

[45] Date of Patent: Sep. 6, 1994

[54] MERCHANDISE DISPLAY SYSTEM

[75] Inventor: Mark Kaplan, Newton, Mass.

[73] Assignee: Laloren, Inc., Stoughton, Mass.

[21] Appl. No.: 954,002

[22] Filed: Sep. 30, 1992

[51] Int. Cl.[5] ..... A47F 5/00

[52] U.S. Cl. ..... 211/1; 206/459.5; 211/59.1; 211/74

[58] Field of Search ..... 211/1, 59.1, 57.1, 74; 40/124; 206/459.5, 493, 581, 540, 466

[56] References Cited

U.S. PATENT DOCUMENTS 1,913,950 6/1933 Platt ..... 206/459.5 X
2,745,596 5/1956 Lorenzsonn ..... 206/459.5 X
3,014,638 12/1961 Farley ..... 206/459.5
3,395,792 8/1968 Larson ..... 206/459.5
3,910,412 10/1975 Vargo ..... 206/459.5

*Primary Examiner*—Robert W. Gibson, Jr.
*Attorney, Agent, or Firm*—John L. Welch

[57] ABSTRACT

A merchandise display system wherein the merchandise and the "gift" packaging for it are separately displayed on the same rack or in the same display, permitting a customer to select and package one or more products so as to create a "gift" collection or assortment, wherein the packaging or container for the various selected products is displayed in the same display as the products. Preferably, the packaging or container bears indicia such as a trademark or trade dress that is the same as, or visually complements, that of the products themselves.

6 Claims, 2 Drawing Sheets

MERCHANDISE DISPLAY SYSTEM

INTRODUCTION

This invention relates to a system for the display and packaging of merchandise sold in retail stores, and more particularly to a system that permits a customer to select and package one or more products so as to create a "gift" collection or assortment, wherein the packaging or container for the various selected products is displayed in the same display as the products. Preferably, the packaging or container bears indicia such as a trademark or trade dress that is the same as, or visually complements, that of the products themselves. This new system is particularly advantageous to the display and sale of small, relatively inexpensive products such as soaps, sponges, brushes, and the like, wherein the packaging for the products themselves bears indicia such as trademarks or trade dress that are the same as, or visually complemented by, the decorations on the bag or box in which the products are to be placed.

The packaging of various products in a "gift" assortment is well known, for example, in connection with certain bath product shops, wherein customers select merchandise and then take the merchandise to a cash register station where a store clerk completes the sale and packages the merchandise, sometimes in packaging that bears the same indicia or trade dress as the products. However, in mass and chain merchandise retail stores and the like, it has not been known to provide in a single display, products and packaging that are complementary, so that a customer may purchase not only products but also packaging in order to create an attractive gift assortment, without the assistance or intervention of store personnel.

One object of the instant invention is to provide a merchandise display system for retail stores, which system presents to the customer both the merchandise and suitable packaging for the merchandise.

Another object of this invention is to provide a display system for both merchandise and decorative packaging, to enable the customer to readily create a "gift assortment" of products in complementary packaging.

Another important object of this invention is to provide a merchandise display system that eliminates the need for the retailer to gift wrap the merchandise.

Yet another important object of this invention is to provide a merchandise display system that enables the customer to create a gift assortment with suitable gift packaging without the aid of a store clerk, gift wrapper or other assistant.

To accomplish these and other objects, in accordance with the present invention, the merchandise and the "gift" packaging for it are separately displayed on the same rack or in the same display. The packaging is suitable for use with many or all of the items for sale in the display, and preferably bears indicia such as the trademark, trade dress, and/or brand name of the products sold on the display. The packaging itself is of a decorative character—such as a decorated bag or box—thus eliminating the need to wrap merchandise at the cash register station, and thereby further reducing the retailer's operating costs.

The instant invention will be better understood and appreciated from the following detailed description of a preferred embodiment thereof shown in the accompanying drawing.

BRIEF FIGURE DESCRIPTION

DETAILED DESCRIPTION

Figure 1:
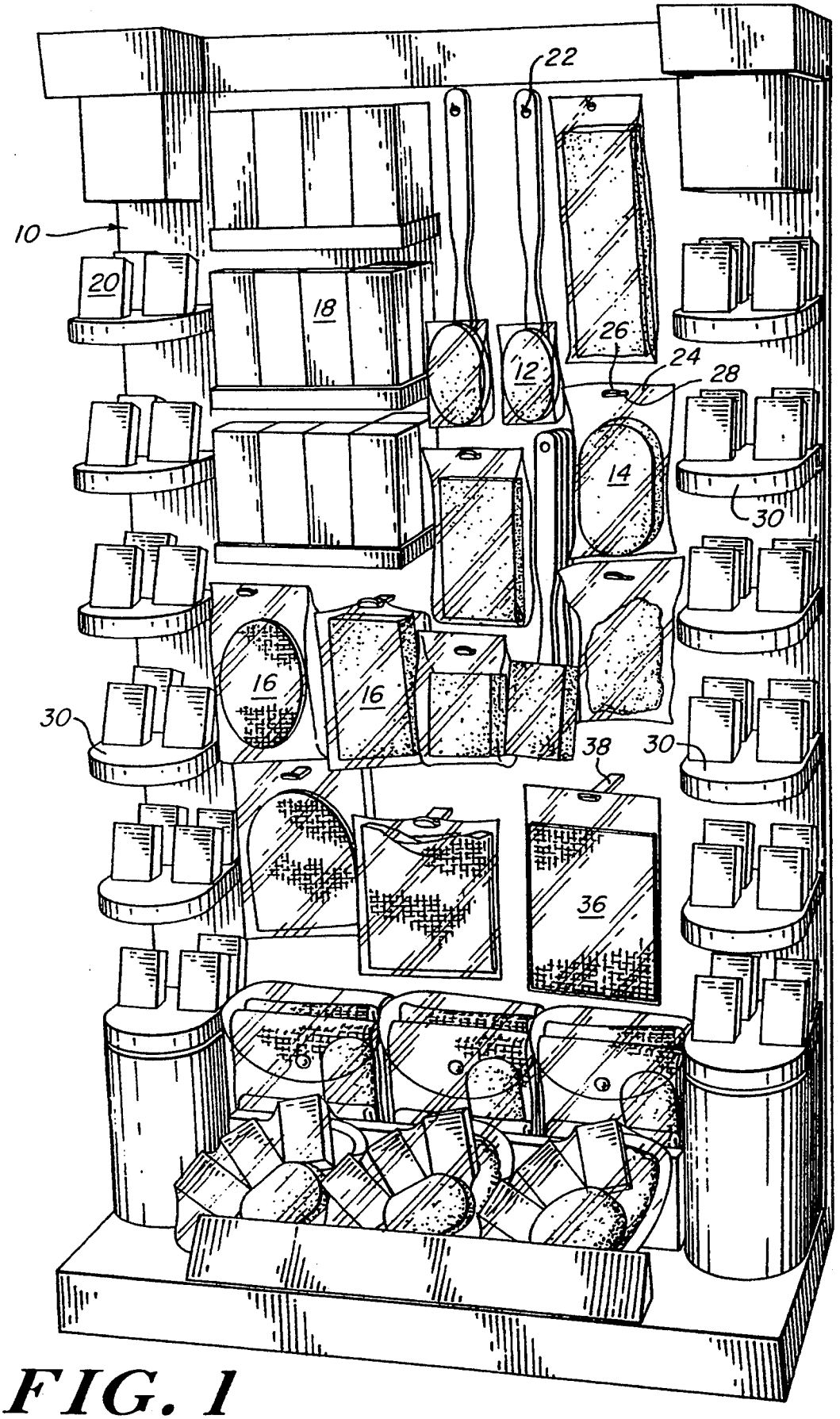
FIG. 1 is a perspective view of a merchandise display system in the form of a display rack bearing a variety of merchandise as well as packaging for the merchandise, in accordance with the present invention.

A merchandise display rack 10 is shown in FIG. 1 carrying a variety of different merchandise items including bath brushes 12, sponges 14, loofas 16, bath gels 18, and soaps 20. The brushes 12 are shown supported on brackets 22 that extend forwardly from the face of the rack 10. The sponges 14 are shown contained in sealed plastic polybags 24 which in turn are supported on brackets 26 that extend through holes in the header portion of the polybags 24. The rack 10 also includes a number of different shelves 30 of different shapes for attractively displaying bath gel, soap, fragrances, and other merchandise. In the embodiment shown, the shelves are provided with a small upstanding rim so as to prevent the merchandise carried on them from falling off the shelves. It will be understood that the display device employed by the retailer may be a free-standing rack such as shown in FIG. 1, or any other display vehicle that the retailer may choose to employ in accordance with the retailer's own standards. The different merchandise is preferably segregated by item so that all the items carried on a particular bracket are the same.

Each of the items of merchandise displayed for sale on the rack carry indicia including the trademark and trade dress of the supplier of the goods on the rack, and the rack itself includes a header 34 which prominently displays the trademark. In the preferred embodiment depicted herein, the products and packaging bear the registered trademark SARAH MICHAELS in its distinctive design form, as well as the distinctive trade dress of the trademark owner, Laloren, Inc. of Stoughton, Mass.

Figure 2:
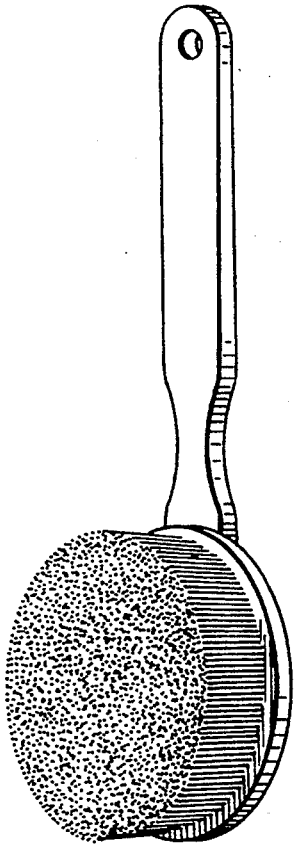
FIG. 2 is a view of the decorative packaging that is separately displayed on the rack of FIG. 1.
Figure 3:
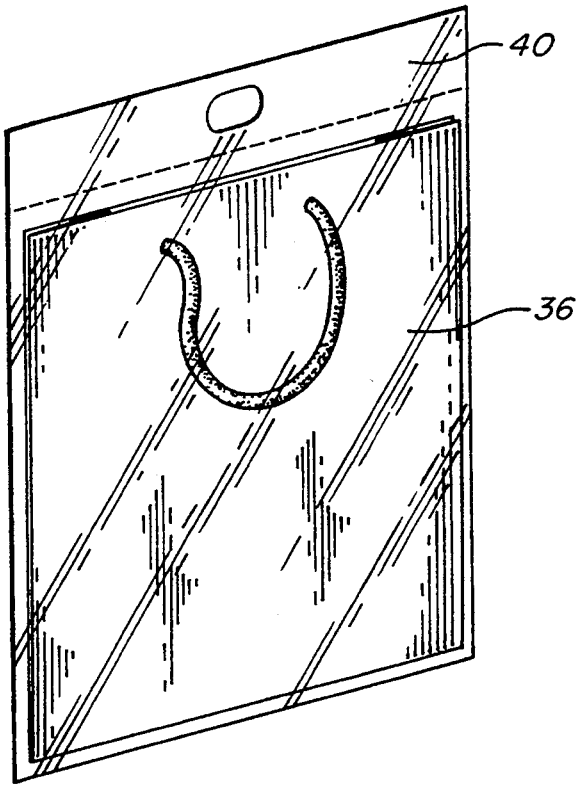
FIG. 3 is a perspective view of the packaging of FIG. 2 as it appears when filled with merchandise selected from the rack.

Appropriate "gift" packaging for all of the items displayed on the rack 10 is separately packaged and displayed for sale on the rack as shown at 36. The packaging itself is contained in sealed polybags 40, and the polybags in turn are carried on a bracket 38 which extends through holes 39 in the header portion of the polybags. (See FIG. 2). As shown in FIGS. 2 and 3, in the preferred embodiment here depicted, the packaging is a decorative bag 37 which is folded flat in the polybag. Tissue wrapping material 44, and, if desired, a gift tag accompany the packaging. The bag prominently carries the trademark of the supplier of the merchandise (i.e., SARAH MICHAELS), and its color and decorative design complement that of the packaging of the merchandise displayed on the rack. The bag itself preferably has rope handles 42, is made of high quality laminated paper that renders it suitable for attractively packaging gift items, and is appropriately sized to receive one or more of the items of merchandise chosen from the rack.

The display or rack, together with the merchandise and packaging carried by it, comprise a merchandise display system that is designed to promote the sale of the merchandise displayed, as well as to lower the retailer's costs by eliminating the need for the retailer to gift-wrap the merchandise which the customer selects from the display. Retail stores of a general character may use the system here disclosed to provide, at low cost to the retailer, an attractive merchandise display.

The system presents to the customer not only the packaged merchandise but also a decorative container for the items displayed on the rack. The common trademark and/or other indicia on the packaging and merchandise items relates the packaging to the items themselves in a manner that is attractive and appealing. At the same time that a customer selects the merchandise, he or she may also select the packaging displayed on the rack, so that both the merchandise and packaging are purchased together. Thus, the customer himself or herself may create an individualized gift collection or assortment of products, without the need for going through a gift wrapping station or otherwise having to wait for a clerk to wrap the items.

Those skilled in the art will appreciate that modifications may be made to this invention without departing from its spirit. While in the display shown the goods are bath items, it will be understood that the display may be used with all kinds of merchandise. Therefore, the invention is not to be limited to the specific embodiment or the specific use of the invention illustrated and described above. Rather, the scope of the invention is to be determined by the appended claims and their equivalents.

I claim:

1. A merchandise display system comprising a display device;

a plurality of packaged products displayed for sale on the display device, by means of which packaging the products are removably attached to the display device; and a plurality of decorative containers also displayed on the display device, said containers being sized to receive one or more of the packaged products, and said containers and said packaged products bearing common indicia.

2. A merchandise display system comprising a display device;

a plurality of packaged products displayed for sale on the display device; and a plurality of decorative containers also displayed on the display device, said containers being sized to receive one or more of the packaged products, and said containers comprising bags with accompanying tissue paper.

3. A merchandise display system as described in claim 1, wherein the indicia on the products and on the decorative containers are visually complementary.

4. A merchandise display system as described in claim 1, wherein each decorative container is itself contained in its own packaging by means of which packaging the decorative container is removably attached to the display device.

5. A merchandise display system as described in claim 3, wherein each decorative container is itself contained in its own packaging by means of which packaging the decorative container is removably attached to the display device.

6. A merchandise display system comprising a display device;

a plurality of packaged products of different sizes displayed for sale on the display device; and a plurality of decorative containers also displayed on the display device, said containers being sized to receive one or more of the packaged products.

* * * * *